United States Patent [19]

Mitchell

[11] 4,414,790

[45] Nov. 15, 1983

[54] HARNESS AND ATTACHMENT METHOD

[76] Inventor: Ronald W. Mitchell, 271 SE. 5th Ter., Pompano Beach, Fla. 33060

[21] Appl. No.: 384,471

[22] Filed: Jun. 3, 1982

[51] Int. Cl.[3] ..... B68B 1/00

[52] U.S. Cl. ..... 54/2; 54/50; 54/23

[58] Field of Search ..... 54/2, 23, 39, 43, 50, 54/51; 280/63, 64

[56] References Cited

U.S. PATENT DOCUMENTS

| | | | |
|---|---|---|---|
| 271,933 | 2/1883 | Smith | 54/23 |
| 455,991 | 7/1891 | Walrath | 54/1 |
| 473,624 | 4/1892 | Grammer | 54/50 |
| 482,243 | 9/1892 | Gregory | 54/50 |
| 527,344 | 10/1894 | Ortega | 54/2 |
| 566,498 | 8/1896 | Clark . | |
| 939,985 | 11/1909 | Crawford | 54/2 |
| 3,408,790 | 11/1968 | Beach | 54/2 |
| 3,445,989 | 5/1969 | Beach | 54/50 X |
| 3,672,123 | 6/1972 | Dykman | 54/2 |
| 3,828,521 | 8/1974 | Dulaney | 54/23 |
| 4,072,000 | 2/1978 | Clemens | 54/2 |
| 4,187,663 | 2/1980 | LaCroix, Jr. | 54/23 |

*Primary Examiner*—Robert P. Swiatek
*Attorney, Agent, or Firm*—Richard M. Saccocio

[57] ABSTRACT

A harness for a horse and sulky comprising a saddle and an elastic girth and a method for attaching the harness to the shafts of a sulky. The saddle includes a bearing strap extending down the sides of the saddle and attaches to each end of the girth. The bearing strap is secured to the top of and at two locations on each side of the saddle. A sulky shaft loop is attached to the bearing strap between the saddle attachment points. A tie down strap attached to the top of the saddle and extending down therefrom is wrapped around the sulky shaft passing through each shaft loop and is tightly secured to the top of the saddle, pulling and securing the shafts and the shaft loops in an upward direction. The shaft loops are adjustably positioned on the bearing straps. A safety strap is loosely fitted to the elastic girth and wrapped around the sulky shafts with slack therebetween.

22 Claims, 11 Drawing Figures

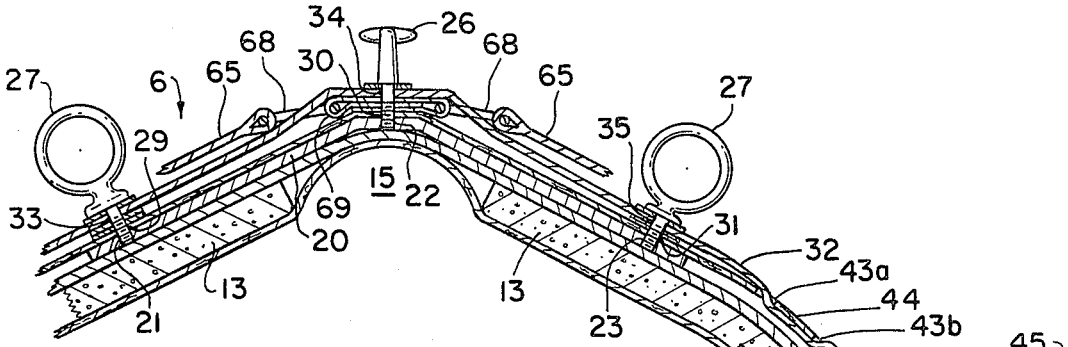
FIG.2
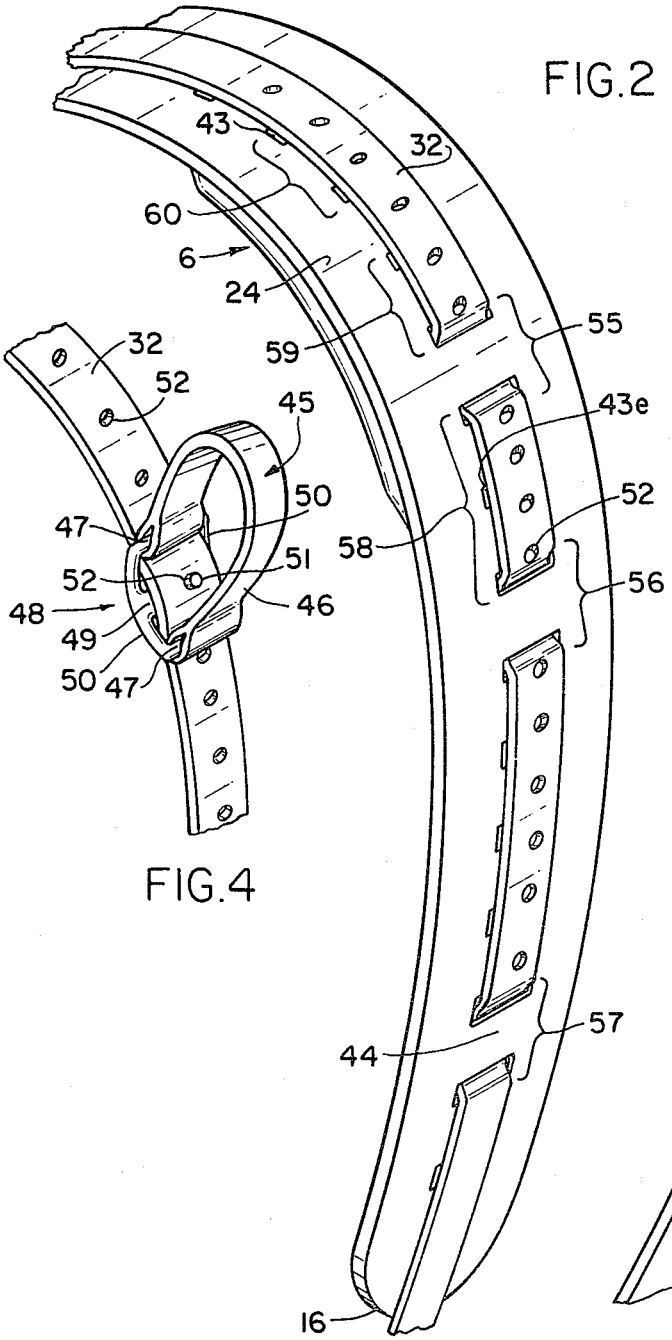
FIG.5
FIG.4
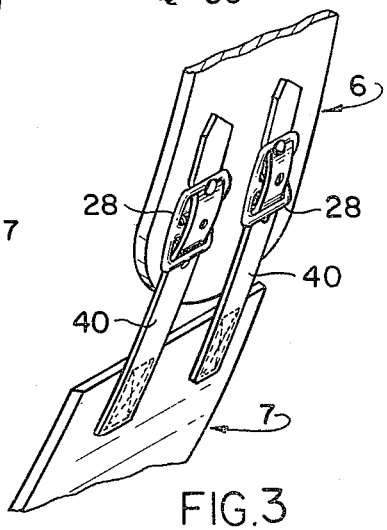
FIG.3

HARNESS AND ATTACHMENT METHOD

BACKGROUND OF THE INVENTION

1. Field of the Invention

This invention relates in general to the field of horse harnesses and in particular to a harness for sulky or harness horse racing.

2. Description of the Prior Art

Harness or sulky racing involves a race horse pulling a sulky or cart with the driver being seated within the cart. Typically, the cart is very lightweight—since it is designed for racing—and comprises a utilitarian frame having two wheels and a driver's seat attached thereto. Two shafts extend from or form part of the frame, creating an opening therebetween within which the race horse is positioned. A harness attaches the shafts of the sulky to the horse. The harness also serves the purpose of being the attachment point for the various reins and lines which the driver uses to control the horse. The present invention is not, however, concerned with the latter purpose. Hence, such lines and reins and their connections to the horse and harness need not be further explained or described herein.

Since the harness connects the horse to the sulky, the harness plays an extremely important role in lap times and the horse's ability to win a race. An efficient harness would transfer all of the energy expended by the horse into propelling the sulky. An inefficient harness wastes a portion of the horse's energy in transferring the same to the sulky and results in slower lap times. Also, an inefficient harness unduly restricts the horse's breathing and prevents the horse from achieving the speed he or she may be capable of attaining.

Although the prior art harnesses have been developed to a high degree, they are nonetheless inefficient as compared to the present invention. One relatively old, but still current by the prior art standards, is that shown in U.S. Pat. No. 566,498, issued Aug. 25, 1896. Even at that early date, it was known that a "rigid hitch" was highly desirable in harness racing. A "rigid hitch" is described by the inventor as a determinate distance between the horse and the sulky at the point of attachment between the two. The inventor then describes in detail his tug strap invention which is not germane to the present invention. Of interest, however, is FIG. 1 of the cited patent which illustrates, almost exactly, the present day prior art method of attaching the sulky shafts to the horse, and, therefore, the present day prior art construction of the harness. A bearing strap is secured to the top of the harness and loosely extends down each side terminating in a loop through which the shaft passes. A girth, which fits around the chest of the horse, is nonelastic and is attached to the saddle or upper portion of the harness. A girth strap is attached to the girth along the entire periphery thereof and wraps around the sulky shaft pulling the shaft down.

In U.S. Pat. No. 4,072,000, issued in 1978, an obviously more contemporary patent, the inventor explains that the sulky is attached to the horse such that a downward pull on the shaft is effectuated in order to control the longitudinal and lateral stability of the sulky. The inventor then describes his invention which also is not pertinent to the present invention. It is to be noted, however, that the harness design of 1896 was still being used in 1978, and to the best of the knowledge of the inventor herein, is still being used today.

In a related field of prior art, in U.S. Pat. No. 3,828,521, issued in 1974, the inventor describes an elastic "cinch" for use with a saddle adapted for use with a riding horse. As explained therein, an elastic cinch is extremely advantageous over a solid nonelastic cinch which is usually made from leather. The nonelastic cinch, having no give, is uncomfortable and restricts a horse's natural breathing. Also, that on occasions, a horse will expand his chest cavity during the application of a saddle such that a "tightened" cinch will later become loose allowing the saddle to slip. Such problems are, as explained, overcome by an elastic cinch.

U.S. Pat. No. 4,187,663, issued in 1980, is yet another example of an elastic cinch being applied to a saddle for a riding horse.

Unfortunately, prior art sulky racing harnesses still use nonelastic cinches or girths. Hence, notwithstanding the known advantages of an elastic girth which have been successfully adapted to riding horses, prior art sulky or harness racing horses still contend with nonelastic girths and their inherent disadvantages. As previously explained, the girth strap is used to pull the sulky shafts down and since it is attached to the girth and is nonelastic, the girth cannot be elastic. If the girth were elastic, the nonelastic bearing strap would negate the effects of an elastic girth.

Although well known for many years to be highly desirable, a rigid hitch is not attainable by the prior art harnesses due to the girth strap and the shaft loop attachment straps. U.S. Pat. No. 3,672,123, issued in 1972, attempted to overcome the forward and aft movement between the sulky shafts and the horse resulting from the prior art girth and loop straps by advancing a rigid shaft loop permanently affixed to the harness. However, such permanent fixation of the shaft loop eliminates adjustments for different sized horses requiring, as the inventor candidly acknowledges, special harnesses for different sized horses.

Accordingly, a primary object of the present invention is to provide a harness which minimizes relative forward and aft movement between the horse and the sulky.

Another object of the present invention is to provide a harness which allows the use of an elastic girth.

Another object of the present invention is to provide a harness which allows a racing horse pulling a sulky to achieve lower lap times.

Still another object of the present invention is to provide a harness which improves the energy transfer between a racing horse and the sulky being pulled by the horse.

Yet another object of the present invention is to provide a harness which will not slip forward, backward or sideway after being initially tightened.

Yet a further object of the present invention is to provide a harness which will allow a horse pulling a sulky to breath more naturally.

Yet a further object of the present invention is to provide a harness which provides a firm attachment of the sulky shafts to the harness.

A still further object of the present invention is to provide a harness which allows for height adjustment of the sulky shafts relative to the horse and relative to the ground.

SUMMARY OF THE INVENTION

The present invention overcomes the problems of the prior art by providing a harness for a horse pulling a sulky which limits forward and aft movement between the horse and sulky and allows the use of an elastic girth.

The harness comprises a saddle portion and a girth portion. The saddle portion includes a bearing strap around the outer periphery of the saddle secured at the top and to one or more spaced locations on the sides. A shaft loop is adjustably positioned to the bearing strap between the connections on each side of the saddle. A tie down strap extends down each side of the saddle, is wrapped around the shaft of the sulky extending through the shaft loop, and is connected to a buckle at the top of the saddle causing the sulky shaft to be pulled in an upwards direction.

An elastic girth is connected to the saddle by connecting the free end of each of the bearing straps to a buckle at each approximate end of the elastic girth. A safety strap may be attached to the outer periphery of the elastic girth and tied to each of the sulky shafts between the tie down strap wrappings. Sufficient slack is maintained between the safety strap tie to the shafts and its connection to the girth so as not to negate the elasticity of the girth.

Various other objects, advantages and features of the invention will become apparent to those skilled in the art from the following discussion taken in conjunction with the following drawings, in which:

BRIEF DESCRIPTION OF THE DRAWINGS

FIG. 2 is a partial cross-sectional view of the saddle portion of the harness of FIG. 1 taken along the line 2—2 thereof;

FIG. 3 shows another embodiment for attaching the saddle to the girth;

FIG. 4 is an isometric view of the shaft loop of the inventive harness connected to a saddle bearing strap;

FIG. 5 illustrates another arrangement of the saddle strap connection to the saddle;

BRIEF DESCRIPTION OF THE PREFERRED EMBODIMENTS

Figure 1:
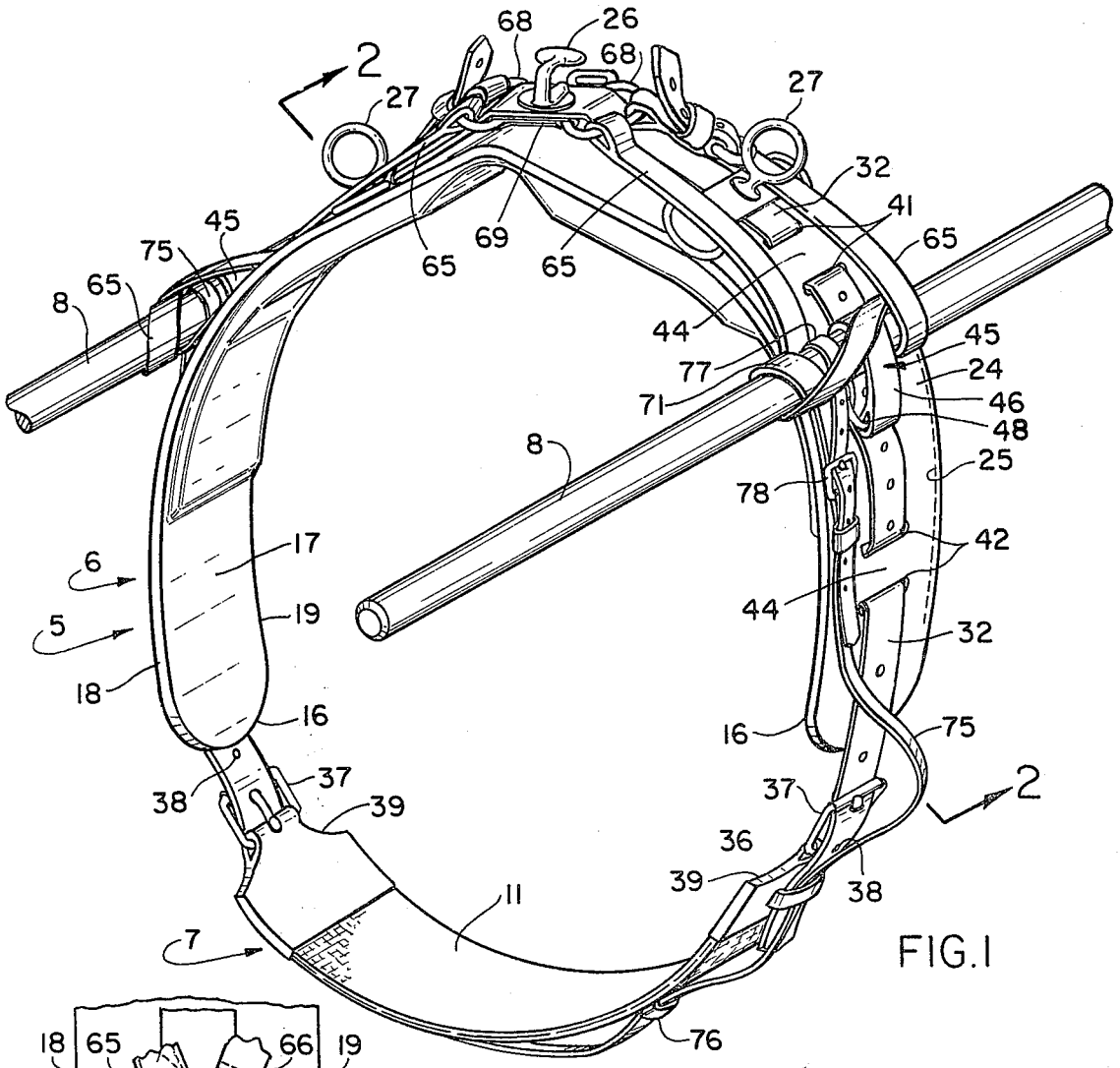
FIG. 1 is an isometric view of one embodiment of the invention harness.

Referring now to the drawings, particularly FIG. 1 thereof, there is depicted and illustrated the inventive harness 5 comprising a saddle portion 6 and a girth portion 7. The harness is, of course, adapted to be fitted to a horse, which is not shown, and a sulky which is also not shown except for the shafts thereof. Harness 5 is intended to fit around the chest and back area of the horse between its front and rear legs as is normal for this type of harness. The sulky or cart to which harness 5 is also intended to be fitted is of the type which has been used in the past. Such a sulky usually includes a frame having two substantially parallel shafts extending toward the horse with two wheels and a driver's seat connected to the frame and behind the horse. The inventive harness 5 is adapted to fit the shafts of the sulky.

A typical harness may also include provisions for attaching a shaft cap which engages the end of the sulky shaft, horse reins for controlling the horse, an overcheck strap, a crupper strap, martingale straps, a hip strap and other such straps which are not shown in the drawings. Such straps and provision for the same while not being shown are necessary to the proper functioning of a harness including the inventive harness 5. However, such straps and the provision for the same may be affixed to the inventive harness 5 in any manner as is and has been commonly known in the art without detracting from the invention described, shown and claimed herein. Hence, such straps and provision for same are not shown in the drawings merely for purposes of simplicity and clarity.

Girth 7 comprises a flat elongated strap 11 preferably made of an elastic material or in such a manner that at least portions of it will expand and contract in general and also in response to the breathing and movements of the horse. The elastic feature is also desirable when a snug fit is attempted to be obtained between the harness 5 and the horse. Horses have been known to take a deep breath or otherwise distend their chest cavity when a harness is being fitted to the horse. If a harness is attached at such time, the harness will loosen when the horse contracts its chest cavity. This, of course, results in an unacceptable fitup between the horse and the sulky. An elastic girth 7 negates any such actions of the horse and effectuates a snug fit between horse, harness 5, and sulky. Elastic girths have been in use in the past in association with saddles for riding horses. They have not, however, been used with a harness for sulky racing. The inventive harness 5 described herein allows the use of the elastic girth 7 as will be more fully explained hereinafter.

The saddle portion 6 is shown in cross section in FIG. 2. A fiber board filler 12 extends across the length and the width of the saddle 6. A pair of pads 13 are attached, such as by glueing, to the center underside of fiber board filler 12 with a space 15 of approximately 3–5 inches therebetween. The space between pads 13 accommodates the raised backbone or withers of the horse. A second pair of pads 14 are also attached to the underside of filler board 12 such that each abuts and forms an extension of pad 13. Pads 14 are thinner than pads 13 to approximately effectuate a continuously tapered pad extending from space 15 at the top of the saddle to a point approximately four-fifths between the top and the end 16 of the saddle 6. A single piece pad may also be used having diverging top and bottom surfaces to actually form a tapered pad. The cost of a true tapered pad would, however, outweigh any beneficial effects it may have over the abutting pads 13 and 14 shown in FIG. 2. Pads 13 and 14 may be made from a high density polyurethane foam or a "hard" semirigid foam. A hard foam will tend to permanently mold itself during use into a configuration in substantial conformance to the shape of the horse at its fitted location. Since horses are generally similarly shaped at this location, once the foam is molded by use it will virtually fit all horses which may use the harness. Moreover, there is sufficient residual resilient "give" to a hard foam, even after being molded by use, to accommodate the shape of any horse and still function as a pad.

A soft, usually calfskin liner 17 is fitted to the inside surface of the saddle 6, over pads 13 and 14. Liner 17 is the portion of saddle 6 which comes into actual contact with the horse. Hence, liner 17 should comprise a material which will not chafe the skin of the horse. Liner 17 is wrapped around edges 16, 18 and 19 of filler board 20 so as to form rounded and smooth edges at edges 16, 18 and 19.

A harness tree 20, usually made from metal and comprising a curved strip having three threaded holes 21, 22 and 23 therein is fitted to the top of filler board 12 at the longitudinal center of saddle 6.

A saddle top cover 24 is fitted to the top surface of harness tree 20 and filler board 12. Cover 24 may be made from a material such as plastic, nylon or leather, or any other like material which is flexible, strong and tear resistant. Liner 17, filler board 12 and top cover 24 may be held together by stitching 25 through the top and bottom surfaces of saddle 6 just slightly inboard of edges 16, 18 and 19. Stitching 25 also serves to connect and maintain the position of harness tree 20 and pads 14 and 13 within saddle 6. A water hook 26 and two line terrets 27 are connected to harness tree 20 by means of threaded holes 21, 22 and 23 in harness tree 20 and serve to further maintain the position of harness tree 20 within saddle 6. Holes 29, 30 and 31 in top cover 24 allow water hook 26 and line terrets 27 to pass through top cover 24 and be connected to harness tree 20.

A saddle or bearing strap 32 is positioned on the top surface of cover 24 and is connected by stitching through saddle 6 for a length approximately equal to the distance between line terret rings 27. Holes 33, 34 and 35 are, therefore, provided in strap 32 to accommodate water hook 26 and line terrets 27. Strap 32 may be made from a strong and flexible manmade material such as nylon or from latigo leather or from a combination of such manmade and natural materials. Strap 32 extends the full length of saddle 6 and beyond each edge 16 for a distance of approximately ten to twelve inches. Each end 36 of strap 32 is attached to girth 7 by means of a conventional buckle 37 which is attached to girth 7. The fitup between strap 32 and buckle 37 is adjustable in accordance with spaced holes 38 in end 36 so that when the harness 5 is fitted to a horse, girth 7 may be stretched to the degree necessary to effectuate a secure fit. Should any looseness of girth 7 be noted, strap end 36 may be unpinned from buckle 37 and pulled to the degree of tightness required, and repinned to buckle 37.

Buckles 37 as shown are each permanently attached to an end portion 39 of girth 7. The attachment of strap end 36 to buckles 37 does not, therefore, interfere with the elasticity of girth 7.

An alternative method of attaching girth 7 to saddle 6 is shown in FIG. 3. In this embodiment, one or more straps 40 connected to girth 7, extend toward and beyond edge 16 of saddle 6 and are fitted to buckles 28 attached to saddle 6. The arrangement shown in FIG. 1 is, however, more preferable since end 36 of strap 32 must in some manner be secured; buckle 37 serves as such and also provides a means to connect girth 7 to saddle 6. By securing end 36 to buckle 37, it, therefore, eliminates the need to have a separate arrangement for securing end 36 and another separate arrangement for connecting girth 7 to saddle 6. It is to be noted that the arrangement shown in FIG. 1 serves both functions.

In one embodiment of the present invention, two pairs 41 and 42 of spaced slots 43 are provided on each side of saddle 6. The first pair 41 of slots 43 may be located approximately seven to ten inches from the top center of saddle 6; the second pair 42 of slots 43 may be located approximately sixteen to nineteen inches from the top center of saddle 6. Each pair of slots 41 and 42 comprise individual slots 43 having a web 44 approximately one and one-half inches wide therebetween. Each slot 43 is just slightly longer than the width of strap 32 to minimize side play and is approximately one-quarter of an inch wide. The ends of slot 43 include rounded corners to reduce the possibility of tearing. Each pair 41 and 42 of slots 43 provides an anchor point for strap 32 on saddle 6 for purposes of limiting the fore and aft movement of the sulky relative to the horse when the horse is running as will be more fully described hereinafter.

The fitup of strap 32 to slots 43 is more clearly shown in FIG. 2. Strap 32 passes down and through the upper slot 43*a*, under web 44 and up and out of lower slot 43*b*. Strap 32 lies flat against outer cover 21 between the pairs 41 and 42 of slots 43 and then passes down and through slot 43*c* under web 44 and up and out of slot 43*d*, whereupon it again lies flat against outer cover 24 until such time as it extends beyond end 16 of saddle 6 and is connected to girth 7.

Shaft loop 45 comprises a strip 46 of a flexible and strong material such as leather or an appropriate manmade material formed into a loop and attached to each end 47 of a "Conway" buckle 48, which as commonly known, comprises a pair of spaced end bars 47 and a center bar 49 joined together by side bars 50. Center bar 49 includes a pin 51 perpendicularly attached thereto and extending therefrom. Each end of strip 46 may be wrapped around an end bar 47 and stitched to the main portion of itself so as to permanently attach strip 46 to Conway buckle 48. In the alternative, rivets or a combination of stitching and rivets may be used to attach strip 46 to Conway buckle 48. Other types of buckles, well known in the art, may be used to attach shaft loop 45 thereto.

Shaft loop 45 is attached to strap 32 between the pairs 41 and 42 of slots 43 on each side of saddle 6 at a desired location consistent with the size of the horse and a predetermined height of shafts of the sulky. The size of shaft loop 45 is slightly larger than the diameter of a sulky shaft 8 which fits within loop 45. Since the location of shaft loop 45 on strap 32 determines the position of the shafts 8 of a sulky relative to a horse, shaft loop 45 is made to be adjustably positioned on strap 32 in order to achieve said predetermined height. Strap 32 fits under end bars 47 of buckle 48 and over center bar 49 and pin 51. Pin 51 fits within one of the plurality of holes 52 provided in strap 32, between pairs 41 and 42 of slots 43. Holes 52 may be approximately spaced from each other by a distance of approximately one-half to one and one-half inches depending upon the desired degree of adjustability of shaft loop 45 on strap 32. Accordingly, shaft loop 45 may be raised by positioning pin 51 of buckle 48 within a hole 52 nearer slot pair 41; or, lowered by using one of the holes 52 nearer slot pair 42. It is to be noted that shaft loop 45 is held in place by a combination of pin 51 and the friction between buckle 48 and strap 32. The frictional force is created by the baring pressure between the horse and harness 5 which results when harness 5 is snugly fitted to a horse.

The approximate nine inch spacing between pairs 41 and 42 of slots 43 on saddle 6 is based in part on: the present day dimensions of a sulky shaft 8; the need or desire to adjustably position shaft 8 on saddle 6 to accommodate different sized horses; and, to limit to an acceptable degree the fore and aft movement of the sulky shaft 8 relative to harness 5. The nine inch dimension has been found through prototype testing to satisfactorily meet the abovestated combination of features. It is to be noted, however, that said approximate nine inch spacing is not absolute and may be increased or decreased. A lesser spacing will further minimize the possibility of fore and aft movement of a sulky relative to a horse. It being understood that a running or trotting or pacing horse will tend to impart lateral fore and aft movement of the sulky being pulled by the horse. Since the harness 5 is attached to the horse, and strap 32 is attached to harness 5, and shaft loops 45 are attached to strap 32 and the sulky or shafts 8 are attached to shaft loops, any lateral motion between strap 32 and harness 5 will result in such undesirable fore and aft motion between the sulky and the horse. A lesser distance between slot pairs 41 and 42 will tend to decrease lateral motion but will also decrease the degree of adjustability of shaft loop 45.

Another arrangement to lessen the fore and aft motion between the sulky and the horse is shown in FIG. 5 which arrangement further lessens the unrestrained length of strap 32 to which shaft loops 45 are attached. In this arrangement, the top cover 24 of saddle 6 is provided with a continuous plurality of slots 43, each spaced approximately one and one-half inches by webs 44. Additionally, slots 43 may be provided on each side of saddle 6 from a location immediately below line terret ring 27 to the end 16 of saddle 6.

In accordance with the arrangement of FIG. 5 and by way of an example, it will be assumed that each shaft loop 45 is to be attached to strap 32 approximately midway between line terret 27 and saddle end 16. It will further be assumed that a length of strap 32 of approximately three inches is desired between its anchor points on saddle 6. Slot pairs 55 and 56 are determined to meet the above-described criteria. Strap 32 is, therefore, fitted through slot pair 55 over a single slot 43*e* and through slot pair 56. Shaft loop 45 is to be fitted to one of holes 52 between slot pairs 55 and 56 as previously explained to accurately adjust the height of sulky shafts 8. Shaft loop 45 is not shown in FIG. 5 for purposes of clarity. Assuming a web dimension of one and one-half inches, the exposed length 58 of strap 32 between slot pairs 55 and 56 is the three inches set forth in the criteria of the given example. Since there is less possible lateral (fore and aft) movement of a three inch length of strap 32 as compared to that of a nine inch length (due to forces between harness and sulky exerted by a horse when running) the possible fore and aft movement of a sulky relative to the harness is lessened.

Should a greater distance between pairs of slots 43 be desired, slot pairs 59 and 56 may be used in place of pairs 55 and 56. Indeed, in the arrangement shown in FIG. 5, any combination of four slots 43 may be used to fix the length of strap 32 (such as length 58) to which shaft loop 45 is to be attached and to fix the position of the sulky shafts 8 relative to harness 5. That is, any one of the holes 52 between the pairs of slots selected (such as the four holes depicted within length 58) may be used to fix the location of shaft loop 45. Should there be a relatively long length of strap 32 between the lower pair of slots 43 which are selected for use and end 16 of saddle 6, such as between slot pair 56 and end 16, strap 32 may be fitted to an additional pair of slots 57 near end 16 so as to minimize an unrestrained long length of strap 32. Although not shown, strap 32 may be similarly fitted to another upper pair of slots, such as pair 60, to further restrain the upper portion of strap 32.

It is to be noted that the examples of the dimensions described for slots 43, strap 32, webs 44 between slots 43, etc., are merely illustrative and are not intended to limit the invention.

Figure 6:
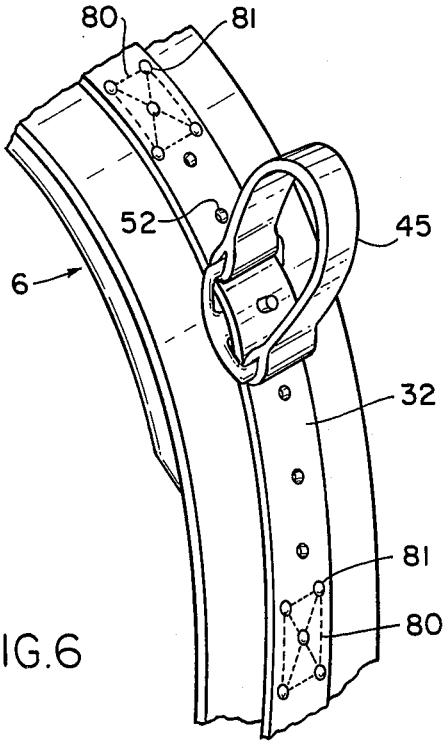
FIG. 6 illustrates still another arrangement of the saddle strap connection to the saddle.

In lieu of slots 43, strap 32 may be connected to saddle 6 at each location above and below shaft loop 45 as shown in FIG. 6 by a combination of stitching 80 and rivets 81. Of course, either stitching 80 or rivets 81 may be used independently of the other. Shaft loop 45 is again adjustable between the attachment points by holes 52.

Again referring to FIG. 1, a shaft tie down strap 65 is secured to the top of saddle 6 and extends downwardly therefrom. The free end of strap 65 is wrapped several turns 71 around shaft 8, on both sides of shaft loop 45, and is attached to another strap 66 and a buckle 67 also secured to the top of saddle 6. Strap 65 is pulled tightly within buckle 67 so as to pull shaft 8 upwards toward the top of saddle 6. The free end of strap 65 is secured to buckle 67 to further firmly fix shafts 8 to harness 5 and to further limit any fore and aft movement of sulky shaft 8 relative to harness 5.

Figure 7:
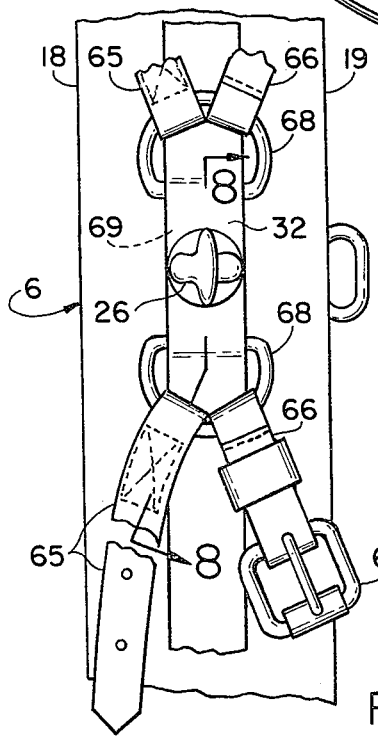
FIG. 7 is a plan view of a tie down strap connected to a saddle.
Figure 8:
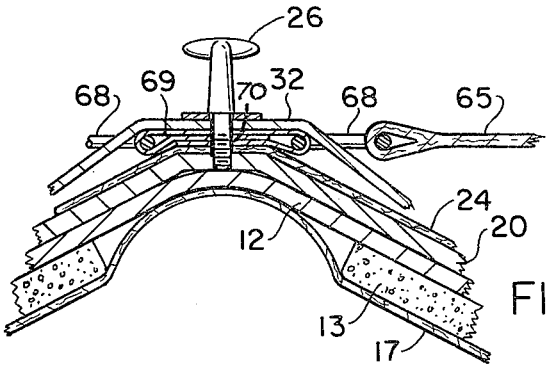
FIG. 8 is a view of the tie down strap connector of FIG. 7 taken along the line 8—8 of FIG. 7.

FIGS. 7 and 8 illustrate one arrangement showing strap 65, strap 66 and buckle 67, and the attachment thereof to saddle 6. A "D" ring 68 is pivotally connected to each end of metal bracket 69. Straps 65 and 66 may be connected to each "D" ring 68 such as by stitching, riveting, or a combination of stitching and riveting or other like method. A hole 70 in bracket 69 is provided to allow passage of the shank of water hook 26 therethrough. Hole 70 serves to connect bracket 69 to saddle 6 by connecting water hook 26 to saddle 6 as previously explained. Bracket 69 is thus allowed to rotate about the shank of water hook 26.

Figure 9:
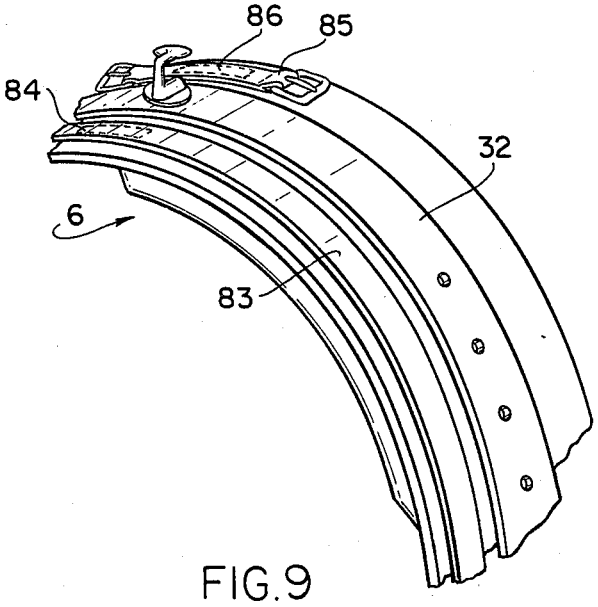
FIG. 9 is another embodiment of the tie down strap.
Figure 10:
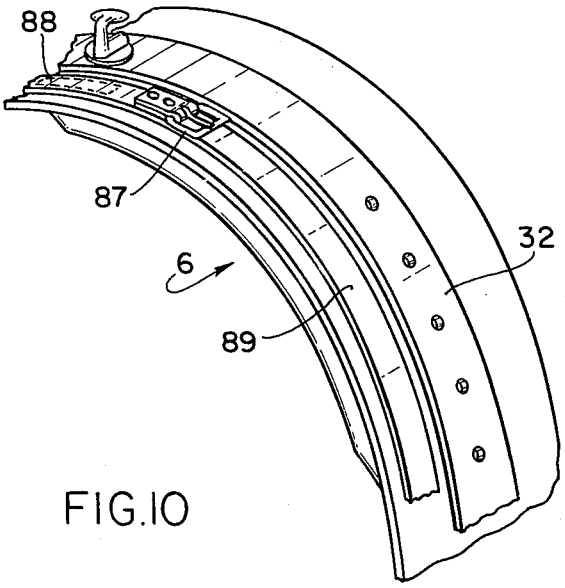
FIG. 10 is still another embodiment of the tie down strap.
Figure 11:
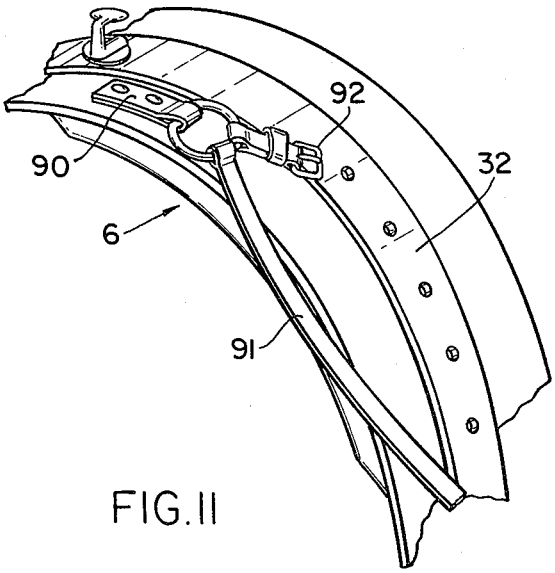
FIG. 11 is still another embodiment of the tie down strap.

As shown in FIGS. 9 through 11, there are a number of acceptable alternate arrangements whereby a strap and a buckle equivalent to strap 65 and buckle 67 may be attached to saddle 6. For example, in FIG. 9, a continuous length of strap 83 may be attached by stitching 84 directly to the top part of saddle 6 with each end depending therefrom for engagement with shaft 8. Similarly, a buckle or a buckle and strap 85 may be directly connected by stitching 86 to either side of the top portion of saddle 6. Or in FIG. 10, a buckle 87 may be directly connected by stitching 88 to the upper portion of strap 89 depending from the top portion of saddle 6. Or in FIG. 11, a separate bracket 90 having strap 91 and a buckle 92 attached thereto comprising essentially one-half of that shown in FIGS. 7 and 8, may be secured to each side of the upper portion of saddle 6. All such arrangements, as well as others reasonably obvious to one skilled in the art are contemplated to be within the scope of the invention described, illustrated and claimed herein.

Again referring to FIG. 1, a safety strap 75 is fitted through a plurality of spaced loops 76 attached to girth 7. Loops 76 may be conventionally attached to girth 7. Strap 75 is loosely fitted within loops 76 so that the elasticity of girth 7 is not affected thereby. Each end of strap 75 is wrapped around a respective sulky shaft 8 one or more turns 77 between the loops of strap 65 and is then secured to itself such as by buckle 78. Sufficient slack is maintained between turns 77 and the portion of strap 75 fitted through loops 76 so as not to interfere with the elasticity of girth 7.

The following is an example whereby the inventive harness is attached to a horse and the shafts of a sulky using the embodiment shown in FIGS. 1 and 2: The saddle 6 is attached to one end of girth 7 by securing one end of strap 32 to buckle 37. The saddle 6 and attached girth 7 are fitted to the horse. The second end of strap 32 is attached to the other end and buckle 37 of girth 7, so as to firmly connect the harness 5 to the horse. A trial fitup between the sulky shafts 8 and shaft loops 45 is effectuated. If necessary, shaft loops 45 are repositioned along the length of strap 32 on each side of the harness so that a desired location of the shafts 8 of the sulky is achieved relative to the horse and harness. The sulky shafts are then fitted to the shaft loops 45. Each end of strap 65 is tightly wrapped one or more turns around each of the sulky shafts 8. Each end of each strap 65 is threaded through its appropriate buckle 67 and pulled hard so as to pull each shaft 8 upwards toward the top of harness 5 (toward the withers of the horse). Each end of each strap 65 is then tightly secured to each buckle 67. Safety strap 75 is then attached to shafts 8. Although not mentioned, the noninventive straps, shaft caps, reins, etc., normally fitted to the horse and sulky are, of course, fitted as appropriate.

While the invention has been described, disclosed, illustrated and shown in certain terms or certain embodiments or modifications which it has assumed in practice, the scope of the invention is not intended to be nor should it be deemed to be limited thereby and such other modifications or embodiment as may be suggested by the teachings herein are particularly reserved especially as they fall within the breadth and scope of the claims here appended.

I claim as my invention:

1. A harness adapted to be fitted to a horse and the shafts of a sulky comprising a girth comprising a first elongated member, a saddle comprising a second elongated member curvingly extending from a top down each side thereof, means for attaching said girth to said saddle, each side of said saddle having a first strap extending down the side thereof, means for attaching said first strap to said saddle, said first strap including a sulky shaft loop adapted to be fitted to one of said sulky shafts, said shaft loop extending outwardly from said saddle whereby said sulky shaft is positioned relative to said saddle at the approximate location of said shaft loop, a second strap connected to said saddle and extending down the side thereof substantially parallel to said first strap, said second strap being wrapped around said sulky shaft and connected to a buckle attached to said saddle at the approximate top thereof such that said sulky shaft is pulled upward.

2. The harness of claim 1, wherein each of said shaft loops comprise a separate strap.

3. The harness of claim 1, wherein said first strap attaching means comprises a pair of openings having a web therebetween in said saddle with said first strap fitting within said openings and under said web therebetween.

4. The harness of claim 3, wherein said saddle includes a cover on an outer surface thereof and said openings for said first strap are located in said cover.

5. The harness of claim 1, wherein said first strap attaching means comprises stitching.

6. The harness of claim 1, wherein said first strap attaching means comprises rivets.

7. The harness of claim 1, wherein said first strap attaching means comprises attachment of said first strap to said saddle at a location on each side of said shaft loop along the length of the side of said saddle.

8. The harness of claim 7, wherein said shaft loop comprises a flexible member and a second buckle, said flexible member being formed into a substantially circular configuration and attached to said second buckle, said first strap being attached to said second buckle, and each of said two attachment locations of said first strap being located adjacent to said second buckle on opposite sides thereof.

9. The harness of claim 1, wherein said first strap attaching means comprises a plurality of openings in said saddle with a web between adjacent openings, said openings extending down each side of said saddle and said first strap loops in and out of two of said openings and under at least one web therebetween at each of two locations along said each side of the saddle, with said shaft loop being positioned between said two locations.

10. The harness of claim 1, wherein each of said shaft loops is adjustably positioned along each side of said saddle.

11. The harness of claim 10, wherein said shaft loop comprises a flexible elongated member and a second buckle with said flexible member being formed into a substantially circular configuration and attached at each end to said second buckle.

12. The harness of claim 11, wherein said first strap includes a plurality of spaced holes, through the thickness thereof, and said second buckle of said shaft loop is attached to at least one of said holes in said first strap.

13. The harness of claim 12, wherein said second buckle includes three spaced parallel rods attached together at their ends by a support bar, with the center of said three rods having a pin perpendicularly attached thereto, said first strap fitting under said outer rods and over said center rod with said pin fitting within one of said holes in said first strap.

14. The harness of claim 1, wherein said second strap is wrapped around said sulky shaft and is attached to said buckle at the approximate top of said saddle whereby each of said shafts and each of said shaft loops is pulled up toward the top of said saddle.

15. The harness of claim 1, wherein said girth is elastic.

16. The harness of claim 15, including a third strap loosely fitted through a plurality of loops attached to said girth and extending from each end thereof.

17. The harness of claim 16, including a buckle attached to each side of said third strap with each end of said third strap being wrapped around a corresponding sulky shaft and attached to said buckle with slack in said third strap between said third strap wrapped around said sulky shaft and said girth.

18. The harness of claim 1, wherein said girth to saddle attaching means comprises a second buckle attached to each approximate end of said girth with said first strap extending down each side of said saddle being attached tautly to said second buckle when said harness is fitted to a horse.

19. A harness adapted to be fitted to a horse and the shafts of a sulky comprising a girth comprising a first elongated member, a saddle comprising a second elongated member curvingly extending from a top down each side thereof, means for attaching said girth to said saddle, each side of said saddle having a first strap extending down the side thereof, means for attaching said first strap to said saddle, a second strap connected to said saddle and extending down the side thereof, a sulky shaft loop comprising a third strap adapted to be fitted to one of said sulky shafts, said shaft loop extending outwardly from said saddle whereby said sulky shaft is positioned relative to said saddle at the approximate location of said shaft loop, a buckle attached to said saddle at the approximate top thereof.

20. A method for attaching a harness to a horse and the shafts of a sulky, said harness including a girth, a saddle curvingly extending from a top down each side of said horse, said girth being attached to said saddle, each side of said saddle having a first strap extending down the side thereof, means for attaching said first strap to said saddle, said first strap including a shaft loop extending outwardly from said saddle, whereby said sulky shaft is positioned relative to said saddle at the approximate location of said shaft loop, a second strap connected to said saddle and extending down the side thereof substantially parallel to said first strap, and a buckle attached at the approximate top of said saddle, comprising the steps of fitting the harness to said horse, fitting the shafts of said sulky within said shaft loops, wrapping the end of each of said second straps one or more turns around the corresponding sulky shaft, fitting the end of each of said second straps through its corresponding buckle, pulling each of said second straps toward the top of said saddle thereby pulling said sulky shafts upward and securing each of said second straps to its corresponding buckle to limit fore and aft movement of said shafts relative to said harness.

21. The method of claim 20, including the step of adjusting each shaft loop along the length of the second strap to fit the size of the horse to which the harness and sulky is being attached.

22. A method for attaching a harness to a horse and the shafts of a sulky, said harness including a girth, a saddle curvingly extending from a top down each side of said horse, said girth being attached to said saddle, each side of said saddle having a first strap extending down the side thereof, means for attaching said first strap to said saddle, a second strap connected to said saddle, a shaft loop comprising a third strap extending outwardly from said saddle, whereby said sulky shaft is positioned relative to said saddle at the approximate location of said shaft loop, a buckle attached at the approximate top of said saddle, comprising the steps of fitting the harness to said horse, fitting the shafts of said sulky within said shaft loops, wrapping the end of each of said second straps one or more turns around the corresponding sulky shaft, fitting the end of each of said second straps through its corresponding buckle, pulling each of said second straps toward the top of said saddle thereby pulling said sulky shafts upward and securing each of said second straps to its corresponding buckle to limit fore and aft movement of said shafts relative to said harness.

* * * * *